United States Patent [19]

Okamoto et al.

[11] 4,413,545

[45] Nov. 8, 1983

[54] MUSIC DATA READING TYPE ELECTRONIC MUSICAL INSTRUMENT

[75] Inventors: Eisaku Okamoto; Kohtaro Mizuno, both of Hamamatsu, Japan

[73] Assignee: Nippon Gakki Seizo Kabushiki Kaisha, Shizuoka, Japan

[21] Appl. No.: 287,560

[22] Filed: Jul. 28, 1981

[30] Foreign Application Priority Data

Jul. 30, 1980 [JP] Japan ..... 55-108084[U]

[51] Int. Cl.[3] ..... G10H 3/03

[52] U.S. Cl. ..... 84/1.28; 84/1.03

[58] Field of Search ..... 84/1.03, 1.28, 461, 84/462, 478

[56] References Cited

U.S. PATENT DOCUMENTS 4,037,511 7/1977 Del Castillo ..... 84/478

*Primary Examiner*—F. W. Isen

*Attorney, Agent, or Firm*—Koda and Androlia

[57] ABSTRACT

An electronic musical instrument having a reading device for reading music-playing data recorded on a part of a music sheet, comprises a musical instrument body having a first groove to support the music sheet during the play of a music and a second groove to initially receive the music sheet and to transfer the sheet into the first groove, with the first and second grooves being continuous to each other. The reading device reads the music-playing data from the sheet as the sheet is transferred through the second groove into the first groove, and supplies the data thus read to an internal memory device. Music is automatically played by successively reading out the music-playing data from the memory device.

6 Claims, 7 Drawing Figures

MUSIC DATA READING TYPE ELECTRONIC MUSICAL INSTRUMENT

BACKGROUND OF THE INVENTION

1. Field of the Invention

This invention relates to an electronic musical instrument which reads data recorded on a part of a music sheet and produces musical tones according to the music data.

2. Prior Art

In the conventional electronic musical instruments of this kind that have been proposed, the following procedure should be taken before starting to play music: First, a music sheet is inserted in the slit of a reading device to read the data recorded on the sheet; the readout data is stored in a memory device in the musical instrument; the music sheet is set on the music stand on the body of the musical instrument; and then the music is played.

This procedure for setting the musical sheet in the reading device and then setting it on the music stand before starting to play is troublesome to a player and it has been desired that the procedure be simplified.

SUMMARY OF THE INVENTION

Therefore, the object of this invention is to provide a new music data reading type electronic musical instrument in which a music sheet recorded with music data is easily set in a position to start playing a music.

It is another object of the invention to provide an electronic musical instrument of the above type in which a procedure for reading out the musical data recorded on the musical sheet and a procedure for setting the musical sheet on the instrument to play a music printed on the sheet are simplified to be instantly carried out by a player.

The electronic musical instrument of this invention has a reading device to read music data recorded on a part of a misic sheet. Preferably an upper surface of the musical instrument body is formed with a first groove to support the music sheet during the play of a music and a second groove to initially receive the music sheet and to transfer the sheet to the first groove, in such a manner that the two grooves are connected with each other to form a single continuous groove. The reading device reads the music data from the sheet as the sheet is moved through the second groove toward the first groove. Based on the music data thus read, musical tones are generated or the musical tone characteristic is controlled.

With the electronic musical instrument of this invention, since the music data is read as the music sheet is transferred through the second groove to the first groove, the sheet setting for data reading and the sheet setting for music playing can be completed in a single continuous process thus greatly simplifying the preparation procedure for music playing.

BRIEF DESCRIPTION OF THE DRAWINGS

The above and other objects, features and advantages of the present invention will become more apparent with reference to the following description taken in conjunction with the accompanying drawings in which.

DETAILED DESCRIPTION OF THE INVENTION

Figure 1:
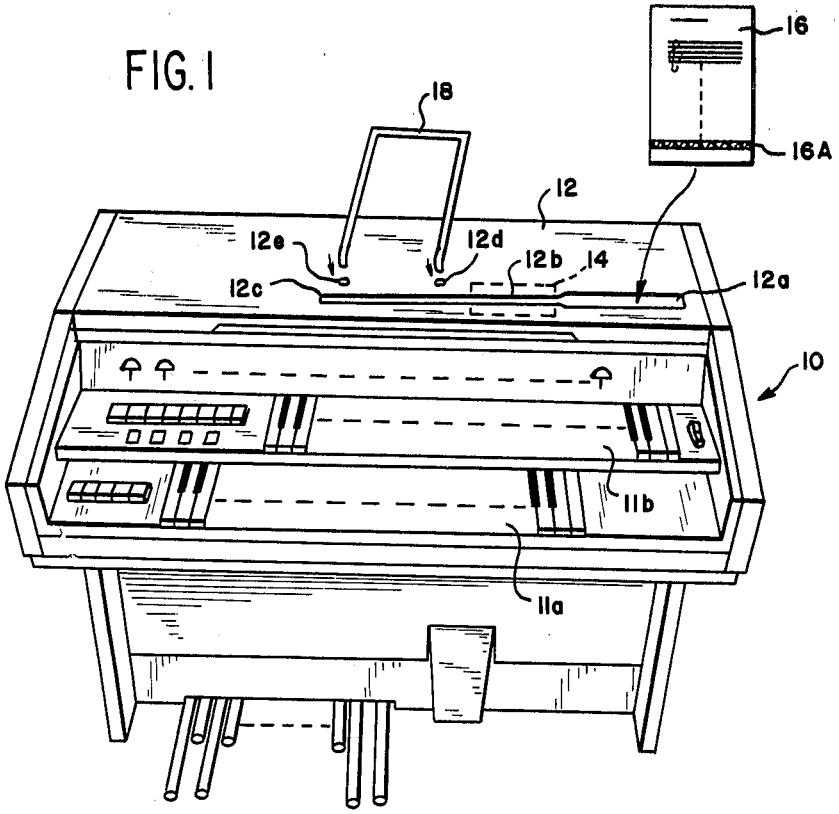
FIG. 1 is a perspective view of an electronic musical instrument shown as one embodiment of this invention.
Figure 1:
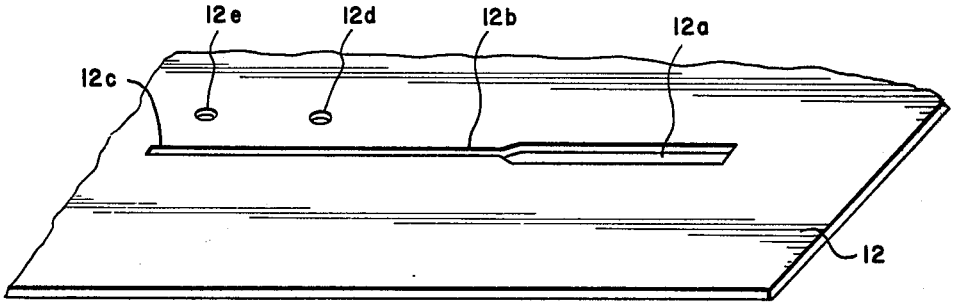
Figure 2:
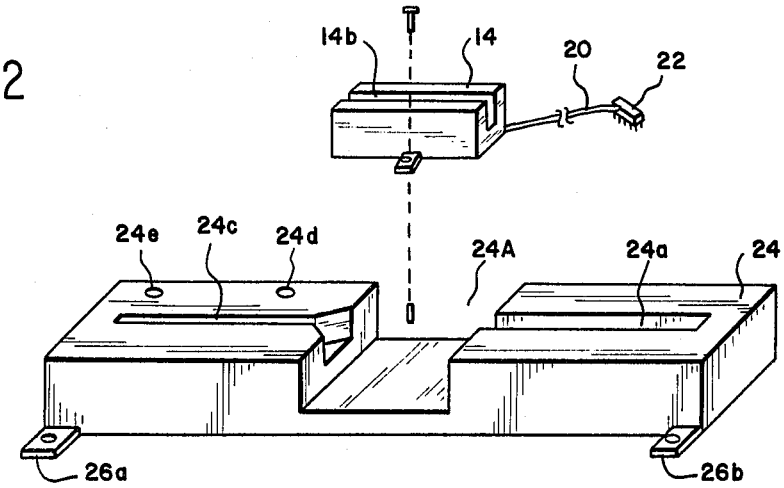
FIG. 2 is an exploded perspective view of a music sheet receiving portion of the above electronic musical instrument.

FIG. 1 shows an electronic musical instrument as one embodiment of this invention. The body of the musical instrument has a lower keyboard 11*a*, an upper keyboard 11*b* and a generally flat top board 12. On the top board 12 there are provided a guide slot 12*a* having a relatively wide width, a reading slot 12*b* and a music sheet supporting slot 12*c* formed behind the keyboards in such a manner that these three slots are continuous almost parallel to the longitudinal direction of the keyboard 11*a* or 11*b*. A music data reading device 14 is provided below the reading slot 12*b*. A music sheet 16 is printed with musical notes of a music to be played and also has, at its lower portion, a recording medium 16A such as magnetic tape on which are preliminarily recorded music-playing data indicating notes, rests, length of notes, etc. of the music and music-playing control data for controlling tone and musical effect. The sheet 16 is inserted into the guide slot 12*a* as shown by the arrow in FIG. 7, and is moved toward the left through the reading slot 12*b* into the supporting slot 12*c* where it is supported with a slight backward inclination. The supporting slot 12*c* is located at a substantially central portion of the top board 12 so that the music sheet 16 supported at the slot 12*c* faces to a player. Provided behind and near the supporting slot 12*c* are a pair of holes 12*d* and 12*e*, into which a music sheet supporting member 18 is inserted to effectively prevent the music sheet 16 set in the slot 12*c* from falling backward. The music sheet 16 is preferably made of plastic and if the sheet 16 is made sufficiently hard, the supporting member 18 is not needed. For data recording onto the sheet 16 the perforation recording technique may be used instead of the magnetic recording.

Figure 3:
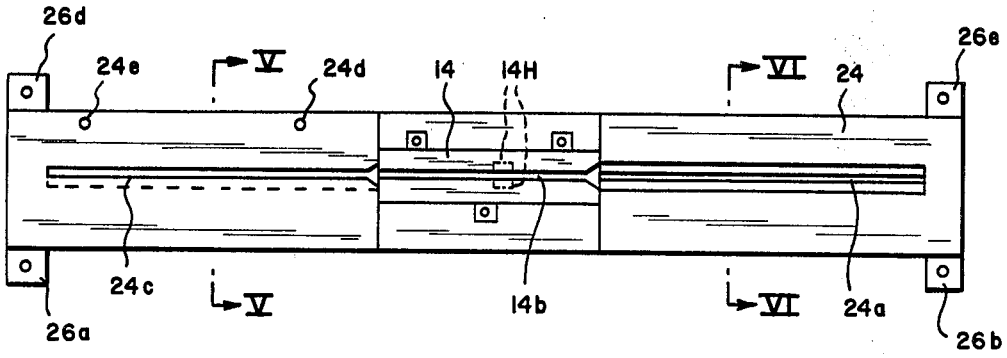
FIGS. 3 and 4 are a plan view and a side view, respectively, showing the internal construction of the above music sheet receiving portion.
Figure 4:
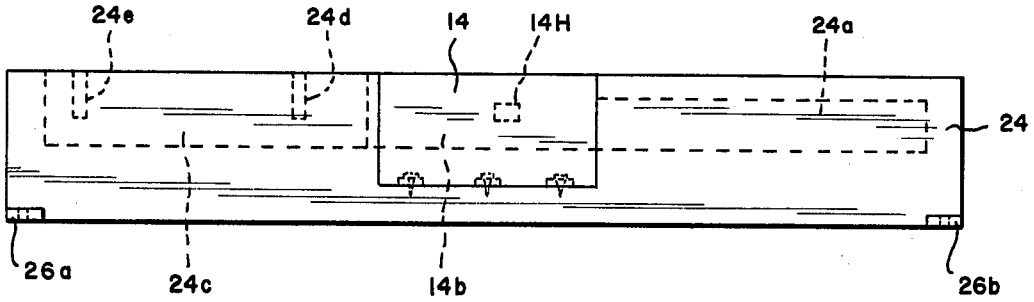
Figure 5:
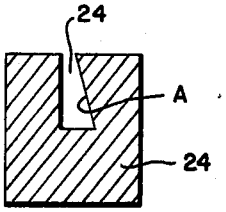
FIGS. 5 and 6 are cross-sectional views of the music sheet receiving portion taken along the line V—V and VI—VI of FIG. 3.
Figure 6:
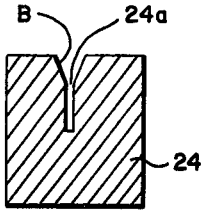

FIGS. 2 through 6 illustrate the details of construction of the music sheet receiving portion of the above electronic musical instrument. The reading device 14 located below the reading slot 12*b* of the top board 12 has a reading groove 14*b* corresponding to the slot 12*b* and a connector 22 with a cord 20, and is fitted into the recess 24A of a holder 24 where it is fixed by screws. On each side of the reading groove 14*b* of the reading device 14 is provided a reading magnetic head 14H as shown in FIGS. 3 and 4. The reading head 14H is located at such height that the head faces the recording tape 16A of the music sheet when the sheet moves through the groove 14*b*. The holder 24 has a guide groove 24*a* and a music sheet supporting groove 24*c* formed in it at locations corresponding to the guide slot 12*a* and the sheet supporting slot 12*c*, respectively, so that the two grooves 24*a* and 24*c* are aligned to form a straight line. The supporting groove 24*c*, as shown in FIG. 5, has its front inner surface A formed sightly inclined backward to tilt the music sheet slightly backward. The rear inner surface of the goove 24c facing the front inner surface A is upright or may be inclinded so that the two inner surfaces are parallel with each other. The guide groove 24a is formed so that its opening B gradually expands outwardly to facilitate the insertion of the music sheet into the groove. The holder 24 has holes 24d and 24e at locations corresponding to the holes 12d and 12e of the top board so as to receive ends of the sheet supporting member 18.

The holder 24 is provided with fixtures 26a, 26b, 26c and 26d at the four corners and is fixed to the upper portion of the musical instrument body beneath the top board 12 by means of the fixtures and screws.

Figure 7:
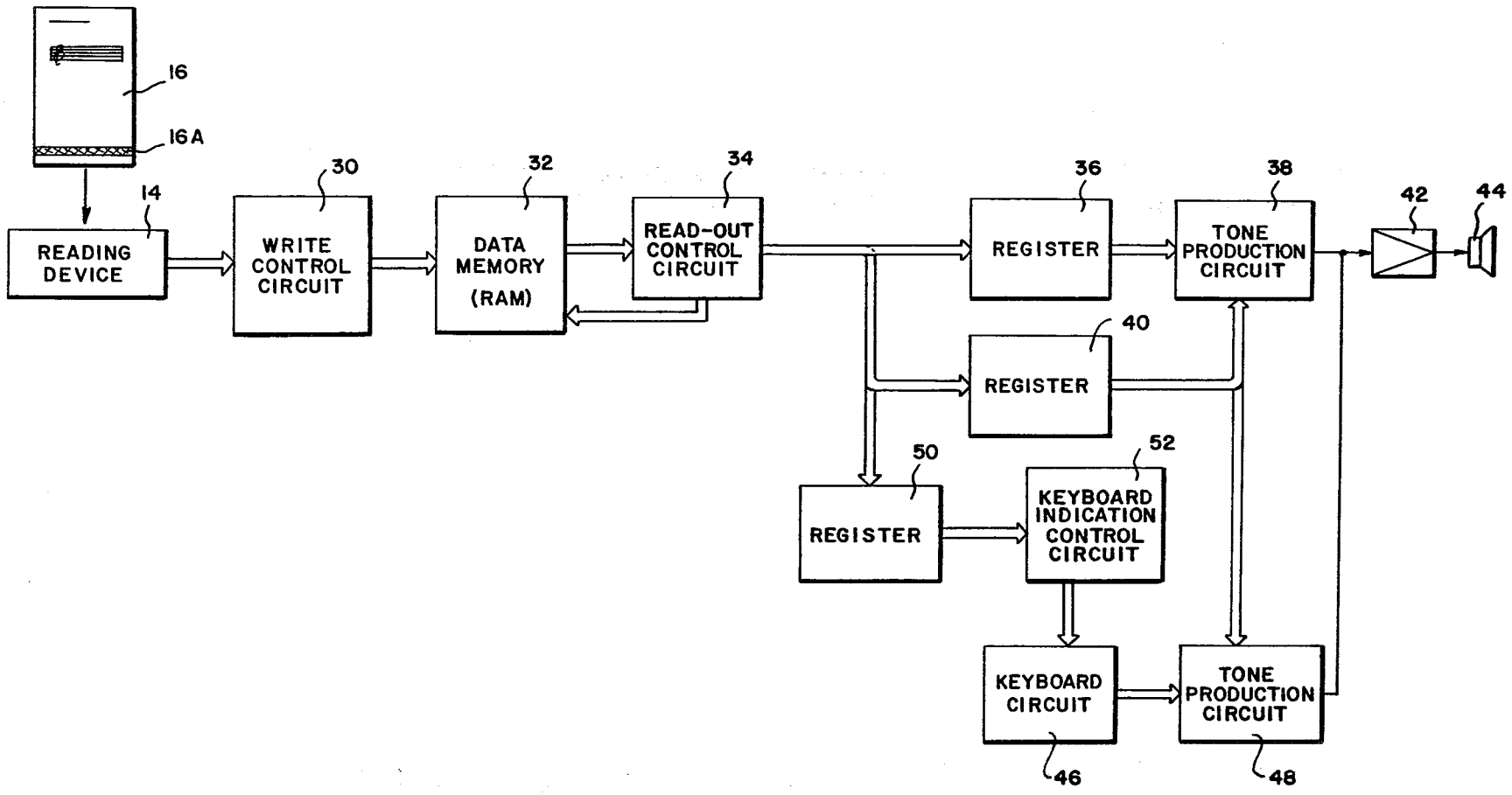
FIG. 7 is a block diagram showing an example of a circuit construction of the above electronic musical instrument.

Now, the operation of the electronic musical instrument will be explained with reference to FIG. 7. A player firstly inserts the lower portion of the music sheet 16 into the guide slot 12a to the bottom of the groove 24a and then moves the sheet toward the supporting groove 24c through the recording groove 14b. The reading device 14 reads the music-playing data and music-playing control data from the recording medium 16A by the reading head 14H when the music sheet 16 is being moved from the guide groove 24a through the reading groove 14b and into the supporting groove 24c. The data thus read are then transferred through the write control circuit 30 to a data memory 32 made up of random access memmory (RAM) where they are stored. The music-playing data and music-playing control data stored in the data memory 32 are successively read out by the read-out control circuit 34, with the music-playing data sent through the register 36 to a tone production circuit 38 for automatic music-playing and with the music-playing control data sent through the register 40 to the tone production circuit 38.

The tone production circuit 38 electronically produces musical tone signals according to the music-playing data from the register 36 and at the same time controls the characteristic of the musical tone signals such as tone color and effect in accordance with the music-playing control data from the register 40. The musical tone signals from the tone production circuit 38 are sent, via a power amplifier 42, to a speaker 44 where they are converted into audible sounds.

On the other hand, keyboard data delivered from a keyboard circuit 46 is supplied to a tone production circuit 48 for manual music-playing. The tone production circuit 48 electronically produces the tone signals based on the keyboard data from the keyboard circuit 46 and controls the characteristic of musical tone signals such as tone color and effect according to the music-playing control data from the register 40. The musical tone signals from the tone production circuit 48 are sent through the power amplifier 42 to the speaker 44 where they are converted into audible sounds.

The music-playing data read out from the data memory 32 is supplied to a keyboard indication control circuit 52 via a register 50. The keyboard indication control circuit 52 selectively lights up lamps or light emitting diodes provided one for each key of the upper keyboard, thus indicating which key should be pressed.

Thus, with the above electronic musical instrument it is possible to automatically play the musical tone by the tone production circuit 38 according to the data read out from the data memory 32 and to automatically indicate on the upper keyboard the keys that should be pressed. This in turn enables the player of the upper keyboard to do effective exercise hearing the automatically played sound and seeing the indication of keys to be pressed.

As can be seen in the foregoing, this invention has the advantage that the music sheet setting can be done in a simple and continuous process because the reading groove and the music sheet supporting groove are so formed in the upper portion of the instrument body that they constitute a single, continuous groove. This advantage of simplification of preparation work before playing is particularly great for a novice player. When a guide groove having a relatively wide opening is formed so as to be continuous to the reading groove, the sheet setting procedure will be simplified still further. It should be also noted that the present invention is applicable, without any substantial modification, to a musical instrument having a single keyboard or keyboards more than three.

Although a few embodiments of the present invention have been described in the foregoing, it will be obvious to those skilled in the art that various modifications and changes may be made without departing from the spirit and scope of the present invention.

We claim:

1. An electronic musical instrument comprising:

(a) a keyboard;

(b) a musical instrument body incorporating said keyboard, said musical instrument body having in an upper surface thereof behind said keyboard a first groove portion for supporting a music sheet during play of music on said music sheet and for holding said music sheet in a position to show a musical representation of musical notes on said music sheet to a player, a second groove portion and a third groove portion and all of which are upwardly opened to accept a lower portion of said music sheet and are arranged continuous to form a music sheet passage extending substantially parallel to a longitudinal direction of said keyboard, said music sheet having at said lower portion a data recording portion carrying music data corresponding to said musical notes;

(c) a reading device disposed at said second groove portion for reading said music data from the data recording portion as the sheet is moved through said music sheet passage from the third groove portion through the second groove portion to the first groove portion; and (d) memory means for storing the music data read out by the reading device.

2. An electronic musical instrument according to claim 1, wherein at least one of inner surfaces of the first groove portion is formed inclined to cause the music sheet to be tilted backward with respect to the keyboard.

3. An electronic musical instrument according to claim 1 or 2, wherein said third groove portion has an upper opening wider relative to the second groove portion, said wider opening of he third groove portion being formed expanding gradually outwardly toward the top of said third groove portion to facilitate initial reception of said music.

4. An electronic musical instrument according to claim 1 or 2, further comprising a music sheet supporting member provided on the upper face of the instrument body to prevent the sheet from being tilted backward with respect to the keyboard in excess of a certain angle when the sheet is supported in said first groove portion.

5. An electronic musical instrument according to claim 1 or 2, wherein said first groove portion is disposed at a substantially central portion of the upper surface of the instrument body so as to support the music sheet in front of a player of the instrument.

6. An electronic musical instrument utilizing a music sheet having a representing portion printed with musical note representation of a music piece and a data record portion at a lower portion of said sheet for carrying music data for reproduction of said music piece, said instrument comprising;

a keyboard having a plurality of keys to be operated by a player;

a music sheet passage comprising a groove having a bottom and an upper opening and located in an upper surface of said instrument behind said keyboard as seen from the player in front of the keyboard, said passage comprising an initial receiving section for receiving the lower portion of said sheet when the sheet is inserted into said passage by the player, a reading section continuous to said initial receiving section for readng the music data out of said data record portion of the music sheet when the music sheet is moved from the initial receiving section through the reading section, and a music sheet holding section continuous to said reading section for holding said music sheet in a position to show said musical representation to the player after said music sheet is moved through said reading section so that the music sheet can be moved in said passage from the initial receiving section to the holding section at a continuous single movement including a readout operation for the recorded music data;

memory means which stores the music data read out at said reading section; and means responsive to the music data from said memory means for generating musical signals corresponding to said recorded music data.

* * * * *